US012342917B2

(12) United States Patent
Krulik et al.

(10) Patent No.: US 12,342,917 B2
(45) Date of Patent: Jul. 1, 2025

(54) COMPRESSION AND EXPANSION LOCKING DEVICE FOR LUGGAGE AND LUGGAGE CONTAINING SAME

(71) Applicant: Briggs and Riley Travelware, LLC, Hauppauge, NY (US)

(72) Inventors: Richard Krulik, Northport, NY (US); Georgene Rada, Northport, NY (US); Daehwan Kim, Plainview, NY (US); Florian M. Witt, Wentorf (DE); Patric Moammer, New York, NY (US); Adrian Berr, Brooklyn, NY (US)

(73) Assignee: BRIGGS & RILEY TRAVELWARE LLC, Hauppauge, NY (US)

( * ) Notice: Subject to any disclaimer, the term of this patent is extended or adjusted under 35 U.S.C. 154(b) by 0 days.

(21) Appl. No.: 18/199,060

(22) Filed: May 18, 2023

(65) Prior Publication Data

US 2023/0371666 A1 Nov. 23, 2023

Related U.S. Application Data

(60) Provisional application No. 63/343,259, filed on May 18, 2022.

(51) Int. Cl.
*A45C 7/00* (2006.01)

(52) U.S. Cl.
CPC ..... *A45C 7/0022* (2013.01)

(58) Field of Classification Search
CPC ..... A45C 7/0022
See application file for complete search history.

(56) References Cited

U.S. PATENT DOCUMENTS 410,934 A 9/1889 Sanders et al.
440,278 A * 11/1890 Payntar ..... A45C 7/0031 190/105

(Continued)

FOREIGN PATENT DOCUMENTS

CA 2688357 C 11/2017
CN 1274330 A 11/2000

(Continued)

OTHER PUBLICATIONS

International Search Report together with the Written Opinion dated Aug. 4, 2023, received in a corresponding foreign application, 7 pages.

*Primary Examiner* — Tri M Mai
(74) *Attorney, Agent, or Firm* — Scully, Scott, Murphy & Presser, P.C.

(57) ABSTRACT

A compression-expansion locking device for an article of luggage and an expandable article of luggage comprising one or more such devices is disclosed. In one embodiment, the device comprises a housing member having two or more columns of parallel housing teeth protruding from an inside surface, and a ratchet member movably disposed over the inside surface and comprising complimentary protruding teeth to releasably engage the housing teeth and a release projection disposed in a slot extending along the axial direction of the ratchet member. A release member slidably disposed within the slot comprises an internal camming surface which when pulled over the release projection by the users urges the ratchet teeth away from the housing teeth to permit movement between the housing and ratchet members. A release button which can be engaged, e.g., by a user's thumb, can be connected to the release member to permit further convenient one-handed operation.

22 Claims, 11 Drawing Sheets

(56) References Cited

U.S. PATENT DOCUMENTS

| | | | | |
|---|---|---|---|---|
| 2,807,488 | A | 9/1957 | Schlage | |
| 2,956,827 | A | 10/1960 | Humphries | |
| 3,401,968 | A | 9/1968 | Carmen et al. | |
| 3,626,730 | A | 12/1971 | Murase | |
| 5,063,760 | A | 11/1991 | Horita et al. | |
| 5,136,864 | A | 8/1992 | Spiekermann et al. | |
| 5,385,220 | A | 1/1995 | Pond et al. | |
| 5,557,954 | A | 9/1996 | Ling | |
| 5,671,830 | A | 9/1997 | Wood | |
| 5,689,979 | A | 11/1997 | Yu | |
| 5,927,110 | A | 7/1999 | Yu | |
| 6,390,259 | B1 * | 5/2002 | Lu | A45C 7/0022 190/103 |
| 6,912,880 | B2 | 7/2005 | Ling et al. | |
| 8,096,150 | B2 | 1/2012 | Lai et al. | |
| 8,161,778 | B1 | 4/2012 | Ma | |
| 9,512,647 | B2 | 12/2016 | Meersschaert et al. | |
| 9,560,902 | B2 * | 2/2017 | Hogan | A45C 7/0031 |
| 9,629,423 | B2 | 4/2017 | Schlipper | |
| 11,766,105 | B2 * | 9/2023 | Krulik | A45C 7/0031 190/104 |
| 2004/0069023 | A1 | 4/2004 | Masseth, Jr. et al. | |
| 2004/0237605 | A1 | 12/2004 | Lin et al. | |
| 2006/0070837 | A1 | 4/2006 | King et al. | |
| 2016/0262515 | A1 | 9/2016 | Kung | |
| 2017/0101237 | A1 | 4/2017 | Capous | |
| 2019/0217877 | A1 | 7/2019 | Webber et al. | |
| 2019/0335867 | A1 | 11/2019 | Hogan et al. | |
| 2020/0370341 | A1 | 11/2020 | Lawrence | |

FOREIGN PATENT DOCUMENTS

| | | | |
|---|---|---|---|
| CN | 106723801 | A | 5/2017 |
| DE | 202005012291 | U1 | 12/2006 |
| GB | 2082241 | A | 3/1982 |
| JP | 3098384 | B2 | 10/2000 |
| WO | 1992008386 | A1 | 5/1992 |
| WO | 2008034006 | A2 | 3/2008 |
| WO | 2011156013 | A1 | 12/2011 |
| WO | 2013037912 | A1 | 3/2013 |

* cited by examiner

COMPRESSION AND EXPANSION LOCKING DEVICE FOR LUGGAGE AND LUGGAGE CONTAINING SAME

This application claims priority to U.S. provisional patent application Ser. No. 63/343,259 filed May 18, 2022, the entire contents of which are incorporated herein by reference for any and all purposes.

FIELD

The disclosure relates to a compression-expansion locking device useful in luggage to securely and selectively increase or decrease the luggage capacity as needed, and to enable compact packing of the luggage article. The disclosure also relates to luggage comprising the compression-expansion locking device.

BACKGROUND

Expandable luggage as known in the art includes various designs to permit the compression and expansion of the luggage, including devices for locking the increased or decreased internal capacity of the luggage in place. Such devices are often composed of multiple parts and pieces that need to be manufactured and fit together, the resulting device itself, when installed in the luggage, typically requiring the person packing the luggage to use two hands to manipulate the device. There is thus a need for a compression-expansion locking device of simpler construction that permits one-handed use.

SUMMARY

In one practice, the disclosure is directed to a compression-expansion locking device for an article of luggage which comprises (a) a housing member that comprises (i) an inside surface comprising two columns of parallel housing teeth protruding from the inside surface, and (ii) a receiving pocket spanning over at least a portion of the inside surface; (b) a ratchet member movably disposed within the receiving pocket, the ratchet member comprising (i) a top end, a bottom end, and opposing side edges, (ii) a first inner surface positioned opposite the inside surface of the housing member and having at least two outwardly protruding parallel ratchet teeth adapted to releasably engage the housing teeth and to allow movement between the housing member and the ratchet member in a compression direction and to lock movement between the housing member and the ratchet member in an expansion direction, and (iii) a slot disposed between the ratchet teeth and along the axial direction of the first surface of the ratchet member, the slot comprising a bottom surface and a release projection extending upwardly from the bottom surface; and (c) an elongated release member slidably disposed in the slot and comprising (i) a first end located proximate the top end of the ratchet member, and a second end located distal to the top end of the ratchet member, and (ii) a header section disposed along at least part of the length of the elongated release member and into which header section at least a portion of the releasable projection protrudes, the header section comprising a first interior camming surface, the header section displaceable from a first position wherein movement of the ratchet member in the expansion direction is locked, to a second position wherein the first interior camming surface impinges against the release projection effective to urge the ratchet teeth away from the housing teeth sufficient to allow movement between the housing member and the ratchet member in the expansion direction.

In another practice, the disclosure is directed to an article of expandable luggage comprising a main luggage body having a bottom surface and a cavity formed to receive articles for packing;

an expansion body having a perimeter defining a cavity; a foldable gusset joining the luggage main body to the expansion body; and a compression-expansion locking device disposed internally at respective opposite inner walls of the article of luggage, the compression-expansion locking device comprising (a) a housing member affixed to one of the luggage main body or the expansion body, the housing member comprising (i) an inside surface comprising two columns of parallel housing teeth protruding from the inside surface, and (ii) a receiving pocket spanning over at least a portion of the inside surface; (b) a ratchet member affixed to the other of the main body or the expansion body, the ratchet member movably disposed within the receiving pocket, the ratchet member comprising (i) a top end, a bottom end, and opposing side edges, (ii) a first inner surface positioned opposite the inside surface of the housing member and having at least two outwardly protruding parallel ratchet teeth adapted to releasably engage the housing teeth and to allow movement between the housing member and the ratchet member in a compression direction and to lock movement between the housing member and the ratchet member in an expansion direction, and (iii) a slot disposed between the ratchet teeth and along the axial direction of the first surface of the ratchet member, the slot comprising a bottom surface and a release projection extending upwardly from the bottom surface; and (c) an elongated release member slidably disposed in the slot and comprising (i) a first end located proximate the top end of the ratchet member, and a second end located distal to the top end of the ratchet member, and (ii) a header section disposed along at least part of the length of the elongated release member and into which header section at least a portion of the releasable projection protrudes, the header section comprising a first interior camming surface, the header section displaceable from a first position wherein movement of the ratchet member in the expansion direction is locked, to a second position wherein the first interior camming surface impinges against the release projection effective to urge the ratchet teeth away from the housing teeth sufficient to allow movement between the housing member and the ratchet member in the expansion direction.

DETAILED DESCRIPTION

Figure 1:
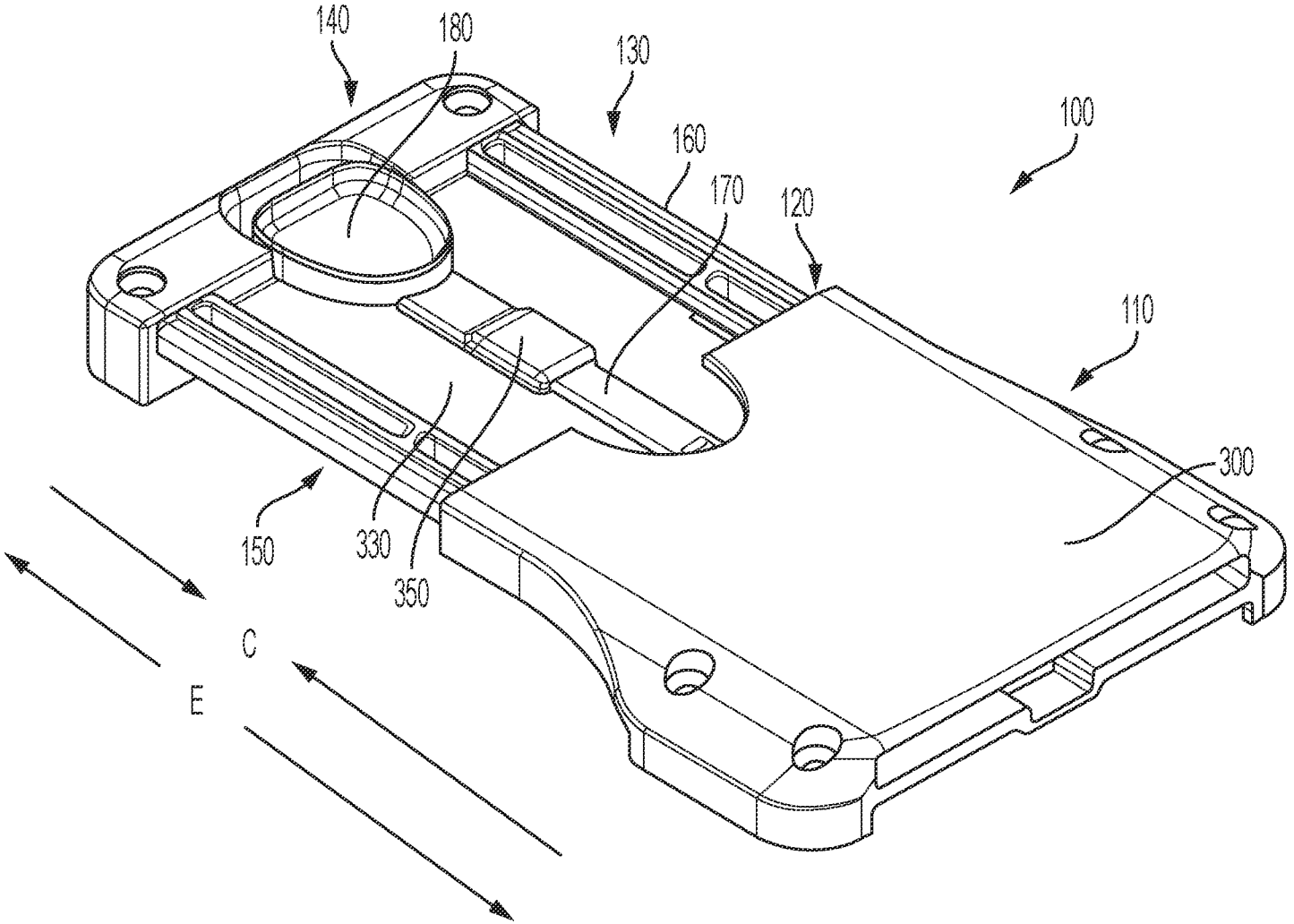
FIG. 1 is a perspective view of the front of an embodiment of a compression-expansion device of the disclosure in an expanded position.
Figure 2:
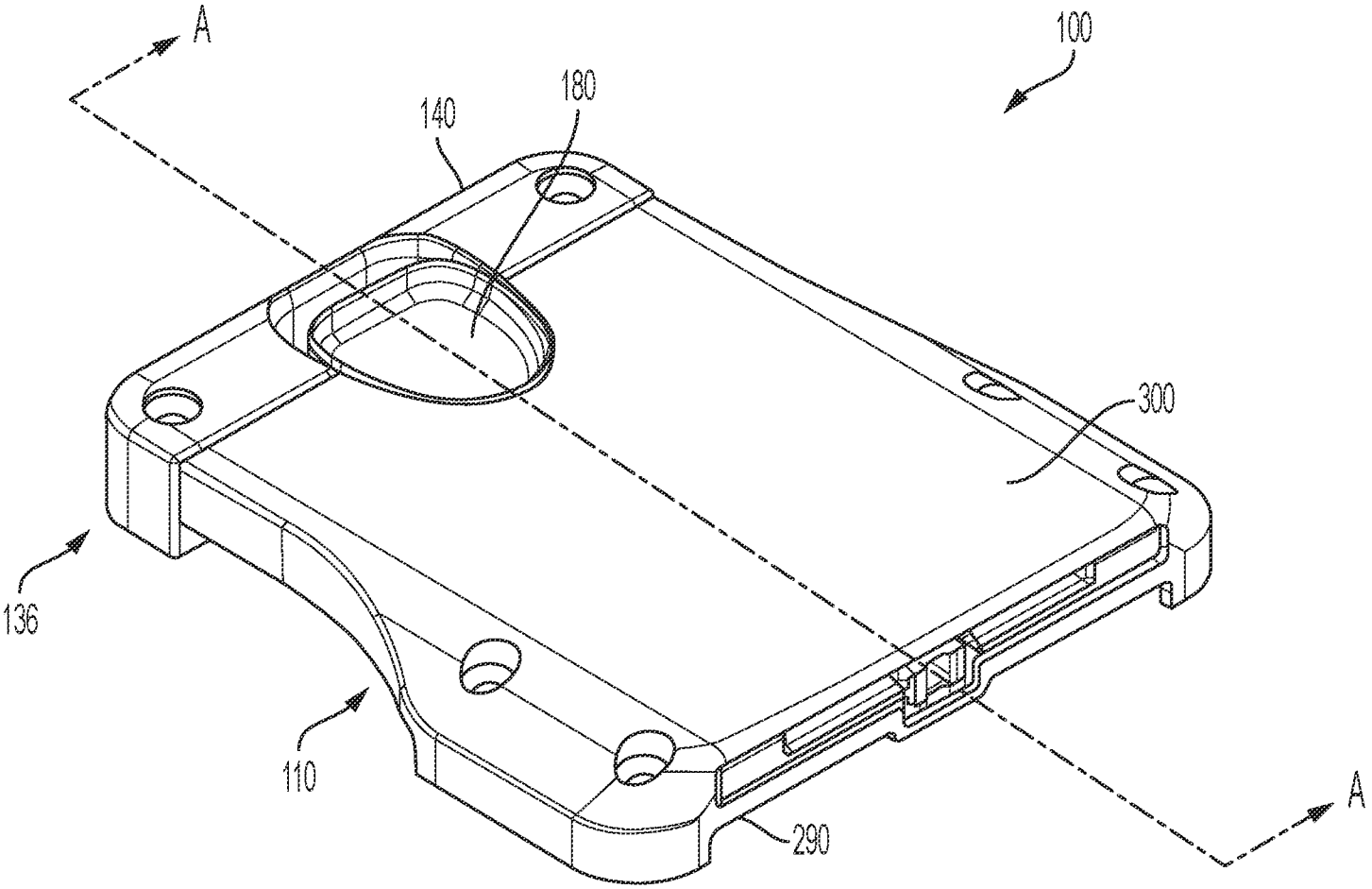
FIG. 2 is a perspective view of the front of the embodiment of FIG. 1 in a compressed position.
Figure 3:
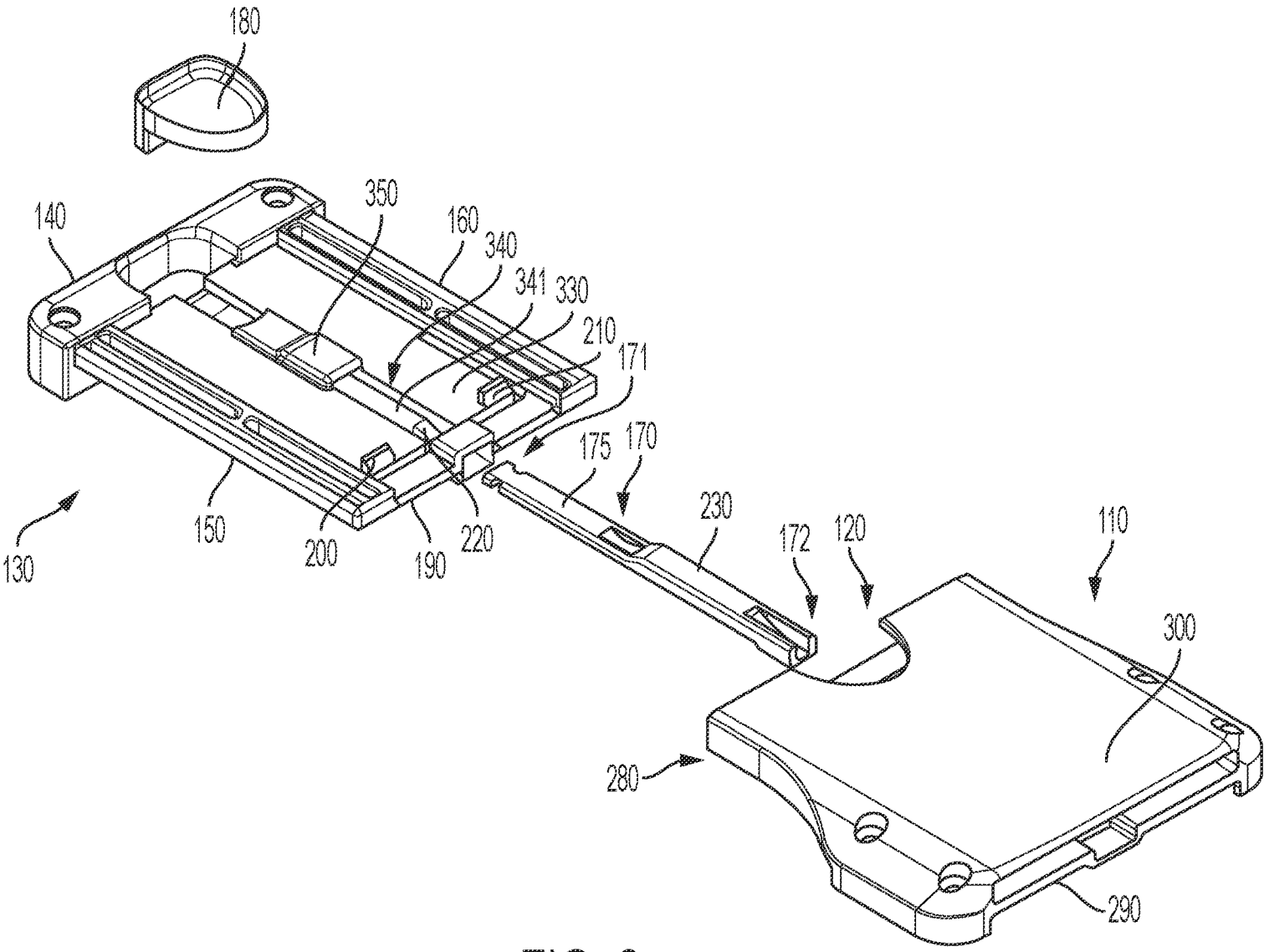
FIG. 3 is an exploded perspective view of the front of the embodiment of FIG. 1.
Figure 4:
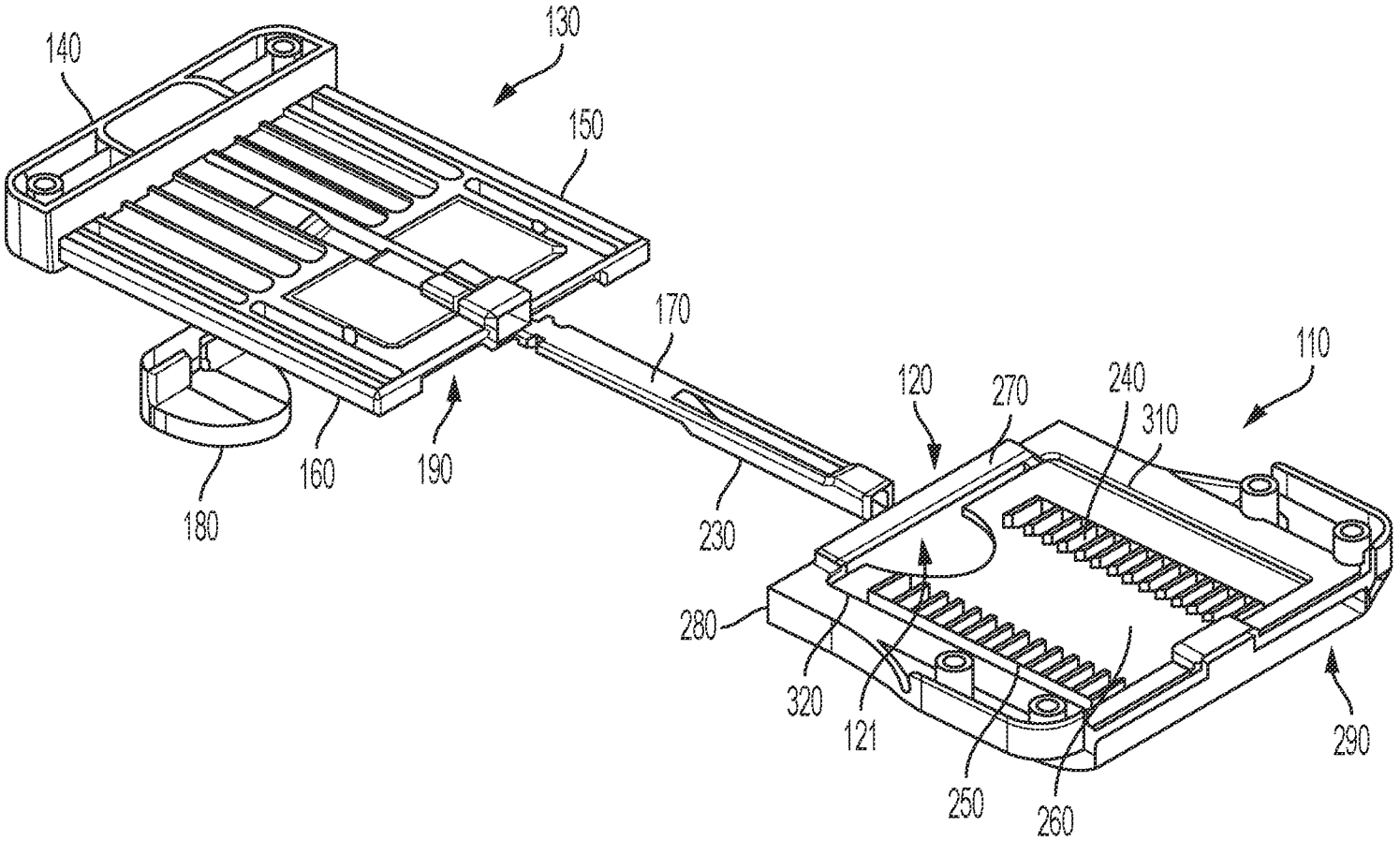
FIG. 4 is an exploded perspective view of the back of the embodiment of FIG. 1.

The ensuing detailed description is made with reference to the figures. This is for convenience only and is not limiting to the scope of the disclosure.

Referring to FIGS. 1 to 7, thereat is an embodiment of the compression-expansion locking device 100 of the disclosure comprising a housing member 110 which comprises an inside surface 260 which comprises two columns of parallel housing teeth, 240 and 250, which protrude upwardly from inside surface 260, and a receiving pocket 120 which in a non-limiting embodiment comprises an edge opening 121 accessing the inside surface 260 and through which edge opening the ratchet member 150 is movable disposed. Receiving pocket 120 can be formed by an arch 270 proximate the bottom end 290 of housing member 110, the arch 270 open at both sides and spanning the entire width of inside surface 260 or can be formed of an outer housing surface 300 that covers all or a portion of the inside surface 260. In one practice, the inside surface 260 can further comprise side walls 310, 320 that extend upwardly from the inside surface 260 and are configured to engage the side edges 150, 160 of ratchet member 130 so as to at least partly guide the movement of the ratchet member 130 into and out of the housing member 110. For example, side walls 310, 320 can comprise respective grooves and/or an inwardly directed peripheral lip adapted to guide the side edges 150, 160.

In the embodiment shown, ratchet member 130 comprises a top end 140, a bottom end 190, and opposing side edges 150 and 160. As depicted, ratchet member 130 comprises a first inner surface 330 which in device 100 is positioned opposite the inside surface 260 of housing member 110 and comprises at least two parallel ratchet teeth 200, 210 that upwardly protrude from inner surface 330, which ratchet teeth 200, 210 are adapted to releasably engage the housing teeth 240, 250 and to allow movement between the housing member and the ratchet member in a compression direction (denoted by arrows C) and to lock movement between the housing member and the ratchet member in an expansion direction (denoted by arrows E). Ratchet member 130 comprises a slot 340 disposed between ratchet teeth 200, 210 and running along the axial direction (the direction from the top end 140 to the bottom end 190) and which slot 340 comprises a bottom surface 341 and a release projection 220 that extends upwardly from the bottom surface 341.

In the practice shown, an elongated release member 170 is slidably disposed within slot 340. In device 100, the elongated release member 170 comprises a first end 171 located proximate the top end 140 of ratchet member 130 and a second end 172 located distal to the top end 140 of the ratchet member 130. Elongated release member 170 comprises a header section 230 which is disposed along at least a part of the length of the elongated release member 170. Header section 230 can comprise an expanded portion of release member 170, for example, a cantilevered section that extends outward from release member 170 and runs along at least part of the length of release member 170 (as depicted), or can comprise a hollow section that runs within at least a portion of release member 170 and can optionally extend outwardly from the top surface 175 of the elongated release member or it can have other suitable designs that permit it to move over or relative to release projection 220, at least a portion of which protrudes into header section 230.

Header section has a first interior camming surface 360, which as depicted in the embodiment shown (FIGS. 6 and 7B) is a slope, e.g. an eloped line that forms an obtuse angle with the top surface 175 of the elongated release member 170; other shapes for the camming surface is contemplated, e.g. the first interior wall can comprise a curved shape, such as a convex shape or concave shape. In the practice depicted, the first interior camming surface 160 is a sloped line and the release projection 220 has a sloped surface 225 complimentary to the slope of the first camming surface 160. In the practice shown, release member 220 is triangular in cross section. Alternatively, the first interior camming surface can be a projection, e.g. a cylindrical or other shaped projection that impinges upon release projection 220. As depicted, the first interior camming surface can form part or all of the end wall of header section 230 and as depicted, the first interior camming surface is distal from the top end 140 of ratchet member 130 although the reverse configuration may be used. For example, a second interior camming surface 361 may be present and form a part or all of the end wall of the header section 230 that is proximate the top end 140 of ratchet member 130. This second interior camming surface 361 can be present in addition to the first interior camming surface 360.

Figure 5:
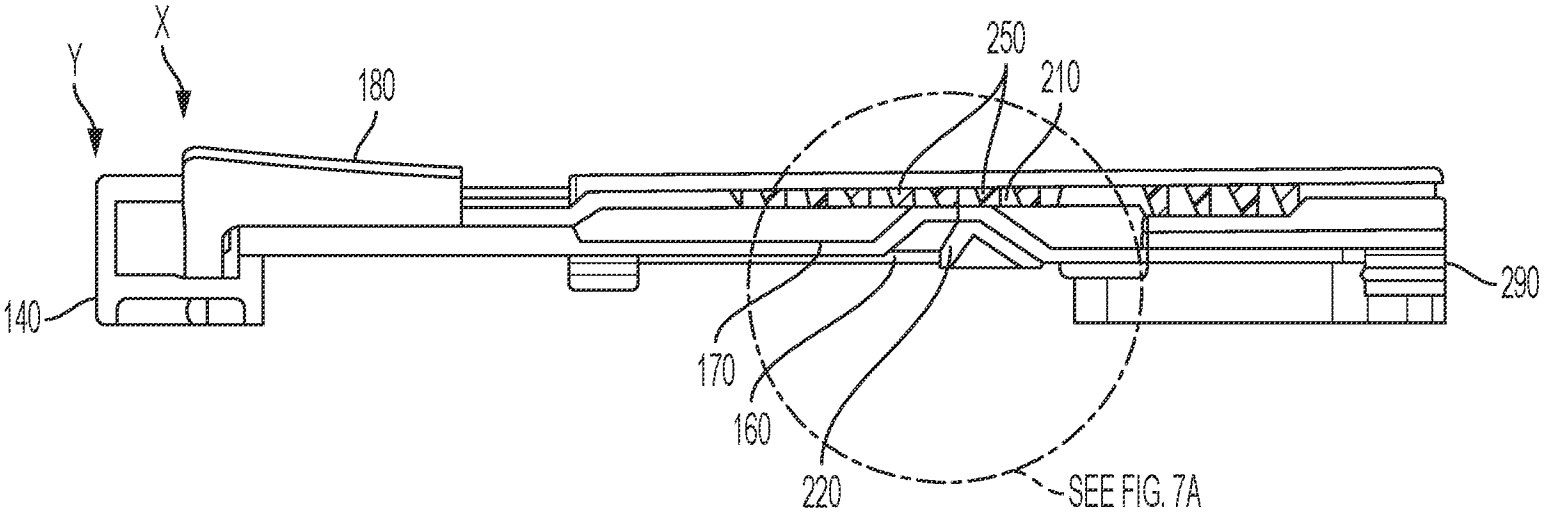
FIG. 5 is a cross sectional side view of the embodiment of FIG. 1 in a compressed position as seen from midline A.
Figure 6:
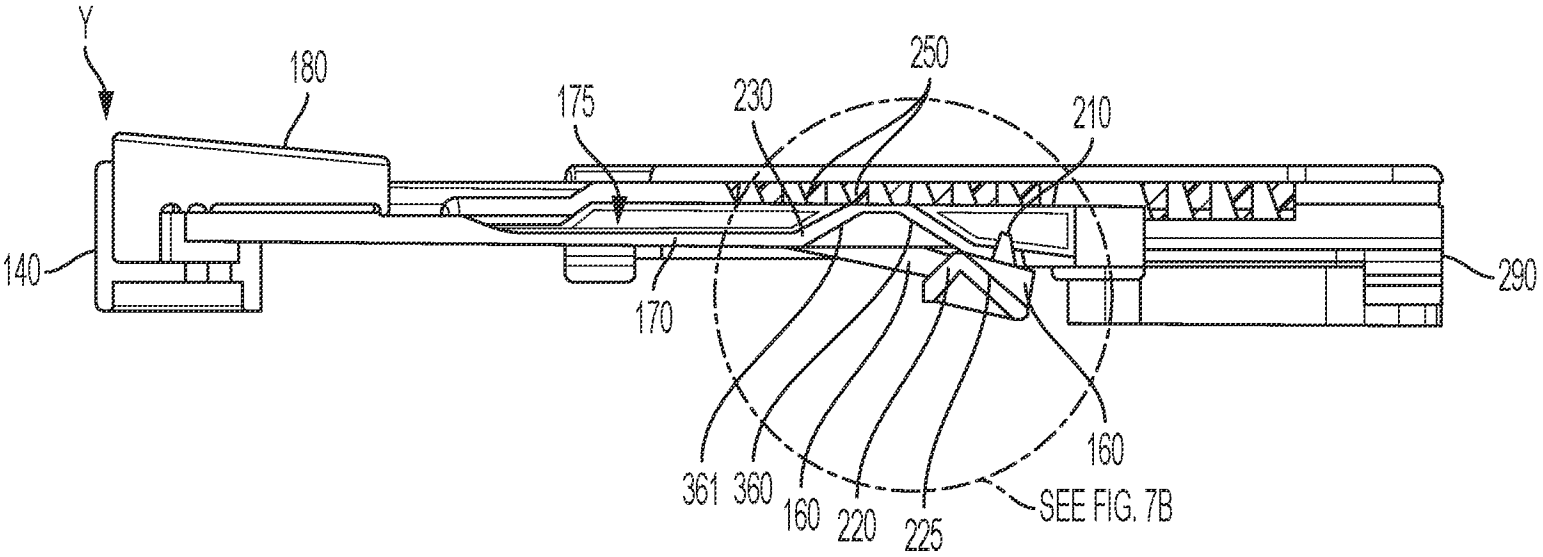
FIG. 6 is a cross sectional side view of the embodiment of FIG. 1 in an expanded position as seen from midline A.
Figure 7A:
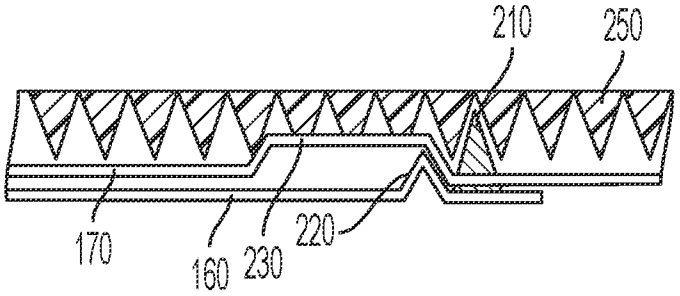
FIG. 7A is a schematic view of aspects of the portion circled in FIG. 5 showing the operation of that embodiment in a compressed position.
Figure 7B:
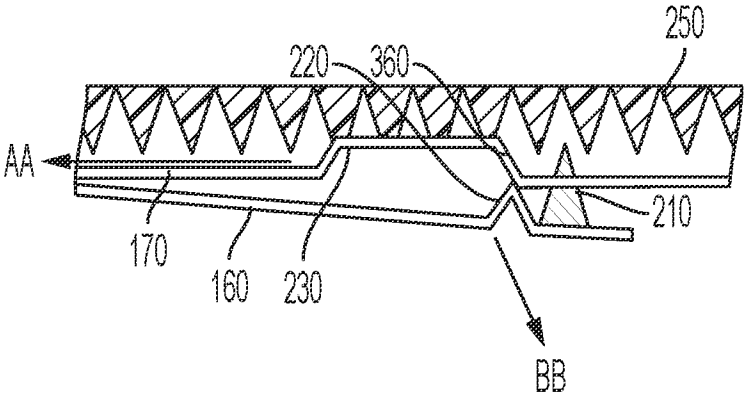
FIG. 7B is a schematic view of aspects of the portion circled in FIG. 6 showing the operation of that embodiment of an expanded position.

Header section 230 comprises part of elongated release member 170 and as such is displaceable from a first position as shown for example in FIGS. 5 and 7A, wherein movement of the ratchet member 130 is locked, i.e., ratchet teeth 200 and 210 are lockingly intermeshed with housing teeth 250 so as to prevent movement in the expansion direction (in FIGS. 7A, 7B, only ratchet tooth 210 and housing teeth column 250 are depicted given the midline view, it being understood that ratchet tooth 200 and housing column teeth 240 although not shown are similarly disposed relative to each other as shown for 210 and 250). In one operational embodiment, the header section 230, which in the practice shown is part of an integral with the elongated release member 170, is displaceable from a first position, as shown in FIGS. 5 and 7A wherein movement of the ratchet member in the expansion direction E is locked due to intermeshing of the ratchet teeth 200, 210, with their respective column of housing teeth 240, 250, to a second position, as shown in FIGS. 6 and 7B (in the direction of arrows AA) wherein the displacement of the header section 230 toward the top end 140 of the ratchet member 130 causes the first interior camming surface 260 to impinge against the release projection 210 effective to cause the release projection 210 and the bottom edge 190 of the inside surface 330 of ratchet member 130 to move in an outward direction (FIG. 7B, arrows BB) thereby urging the ratchet teeth 200, 210 away from the housing teeth 240, 250 sufficient to allow movement between the housing member and the ratchet member in the expansion direction E.

In one practice, a release button 180 is connected to the first end 171 of the elongated release member 170 and configured to be moved to the top end 140 of the ratchet member whereby the header section is displaced to the second position as described above. For example, the release button may be configured to be move along the axial direction of the ratchet member by the user from position X (FIG. 5) where the device is in the first position and locked, to position Y where the device is in the second position and can be expanded. For example, release button 180, when disposed internally inside an article of luggage, can optionally comprise a slightly depressed or notch or other tactile surface and a user can place a thumb onto the button, e.g. into the depression, and with that same one hand conveniently slide the button from position X to position Y. When two compression-expansion devices according to the disclosure are disposed on opposite inner walls of an article of luggage, the user can simultaneously use the thumbs of each hand to unlock each device by moving their respective buttons from their respective X to Y positions. The design of the compression-expansion device of the disclosure hence permits quicker and more efficient operation. In another practice, the ratchet member 130 comprises a brace 350 disposed over the slot 340, the brace 350 configured to retain the elongated member 170 within the slot 340 especially during use.

The compression-expansion locking device may comprise any suitable material of construction or combinations of such materials, including without limitation materials that are rigid yet flexibly resilient enough to permit the urging away of the housing teeth from the ratchet teeth, e.g. all or part of the device, such as the first inside surface 330 of the ratchet member 130 can comprise plastic, including without limitation plastics exemplified by polyoxymethylene copolymer (POM-C) high rigidity grade. Thickness of material can be altered as well to achieve the urging effect, e.g. the thickness can be made thinner sufficient to cause the urging away.

FIGS. 8A, 8B, 8C, and 8D depicts various embodiments of an article of luggage contemplated by the disclosure embodying the compression-locking device of the disclosure, e.g. as shown in FIGS. 1 to 7. Article of luggage 400 comprises a main luggage body 440 having a bottom surface 441 forming a cavity to receive articles for packing. The article of luggage further comprises an expansion body 420 having a perimeter defining a cavity. Foldable gusset 430 joins luggage body 640 to expansion body. Foldable gusset 430 allows the expansion body to move towards the luggage main body in order to vary the size of a volume formed by the cavity of the luggage main body and the cavity of the expansion body. Gusset 430 can be foldable or compressible and can comprise cloth or other suitable material. Cover 410 is attached to the expansion body 420 and is sealable and openable by e.g. zippers and the like. Article of luggage 400 can be soft-sided or hard-sided or combinations of both and can comprise materials of construction including cloth, metal and plastic. Article of luggage 400 can comprise spinner wheels 490 or rolling wheels or feet or any combination of the foregoing and can comprise one or more handles including a telescoping handle attached to main luggage body. In one embodiment, at least one compression-expansion locking device as described herein is disposed on a wall (internal or external) of the article of luggage. Multiple such devices can be installed, e.g. at opposing inner walls. at least one compression-expansion locking device disposed on a wall of the article of luggage.

Figure 8A:
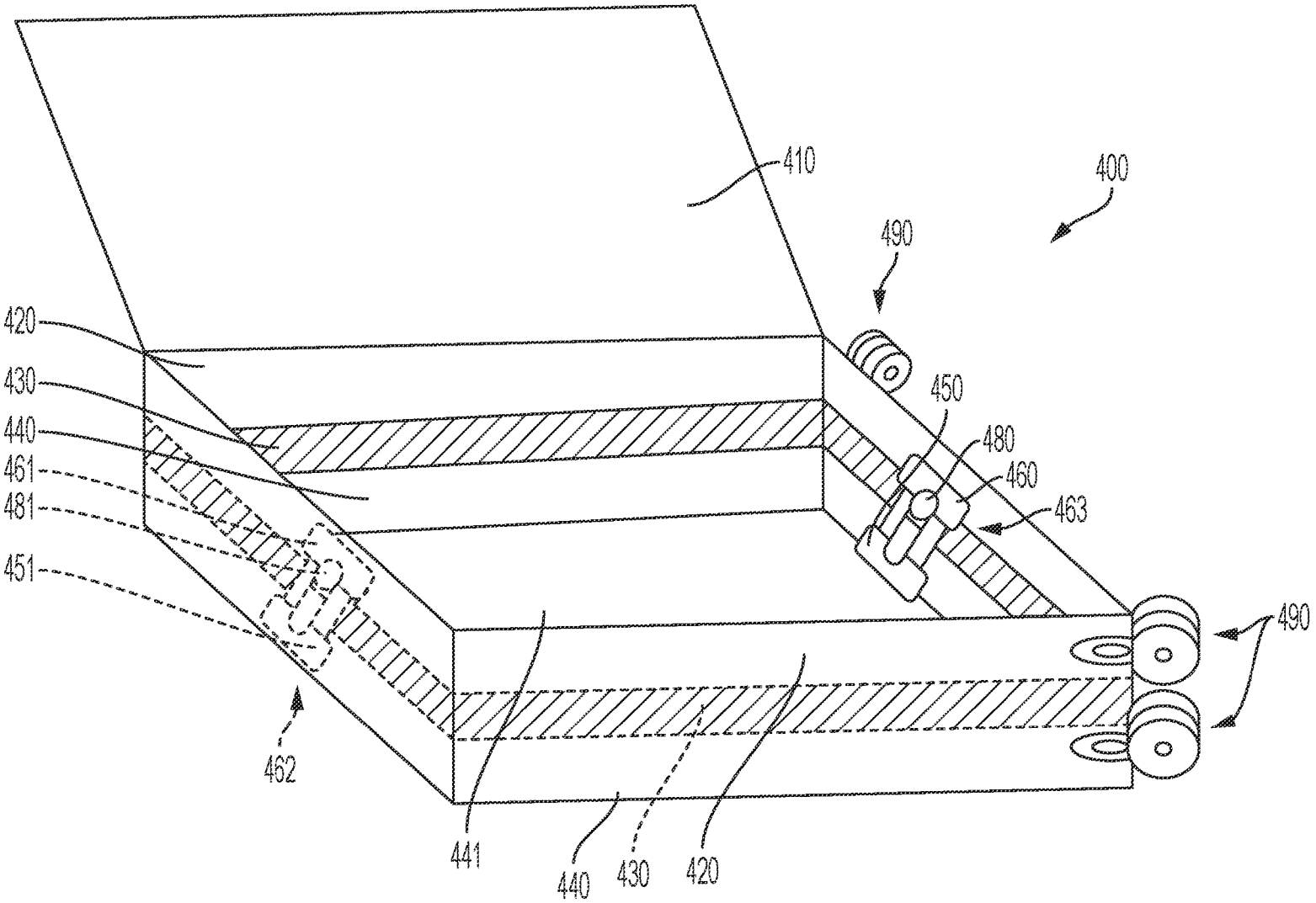
FIGS. 8A, 8B, 8C, and 8D are perspective views of embodiments of an article of luggage for the disclosure employing a pair of compression-locking devices as shown in FIG. 1 on the inside of the luggage (FIGS. 8A, 8B) and on the outside of the luggage (FIGS. 8C, 8D).

As shown in the non-limiting practice of FIG. 8A, two compression-expansion locking devices 462, 463 are disposed internally at respective opposite inner walls of the article of luggage 400. In other practices, one or more than two compression-expansion locking devices can be used. As shown in FIG. 8A, the compression-expansion locking device can comprise, for example, as described herein, a housing members 450, 451, each affixed to one of the luggage main body or the expansion body, and ratchet members 460, 461, and release buttons 480, 481. Each housing member 450, 451, comprises (i) an inside surface comprising two columns of parallel housing teeth protruding from the inside surface, and (ii) a receiving pocket spanning over at least a portion of the inside surface. Each ratchet member 460, 461 is movably disposed within a respective receiving pocket and comprises (b) a ratchet member movably disposed within the receiving pocket, the ratchet member comprises (i) a top end, a bottom end, and opposing side edges, (ii) a first inner surface positioned opposite the inside surface of the housing member and having at least two upwardly protruding parallel ratchet teeth adapted to releasably engage the housing teeth and to allow movement between the housing member and the ratchet member in a compression direction and to lock movement between the housing member and the ratchet member in an expansion direction, and (iii) a slot disposed between the ratchet teeth and along the axial direction of the first surface of the ratchet member, the slot comprising a bottom surface and a release projection extending upwardly from the bottom surface. Each compression-expansion locking device 462, 463 also comprises an elongated release member slidably disposed in the slot, which elongated release member comprises (i) a first end located proximate the top end of the ratchet member, and a second end located distal to the top end of the ratchet member, and (ii) a header section disposed along at least part of the length of the elongated release member and into which header section at least a portion of the releasable projection protrudes, the header section comprising a first interior camming surface, the header section displaceable from a first position wherein movement of the ratchet member in the expansion direction is locked, to a second position wherein the camming surface impinges against the release projection effective to urge the ratchet teeth away from the housing teeth sufficient to allow movement between the housing member and the ratchet member in the expansion direction. In the practice depicted at FIG. 8, release buttons 480, 481 are connected to the first end of their respective elongated release member and each button is configured to be moved to the top end of the ratchet member whereby the head section is displaced to the second position.

Figure 8B:
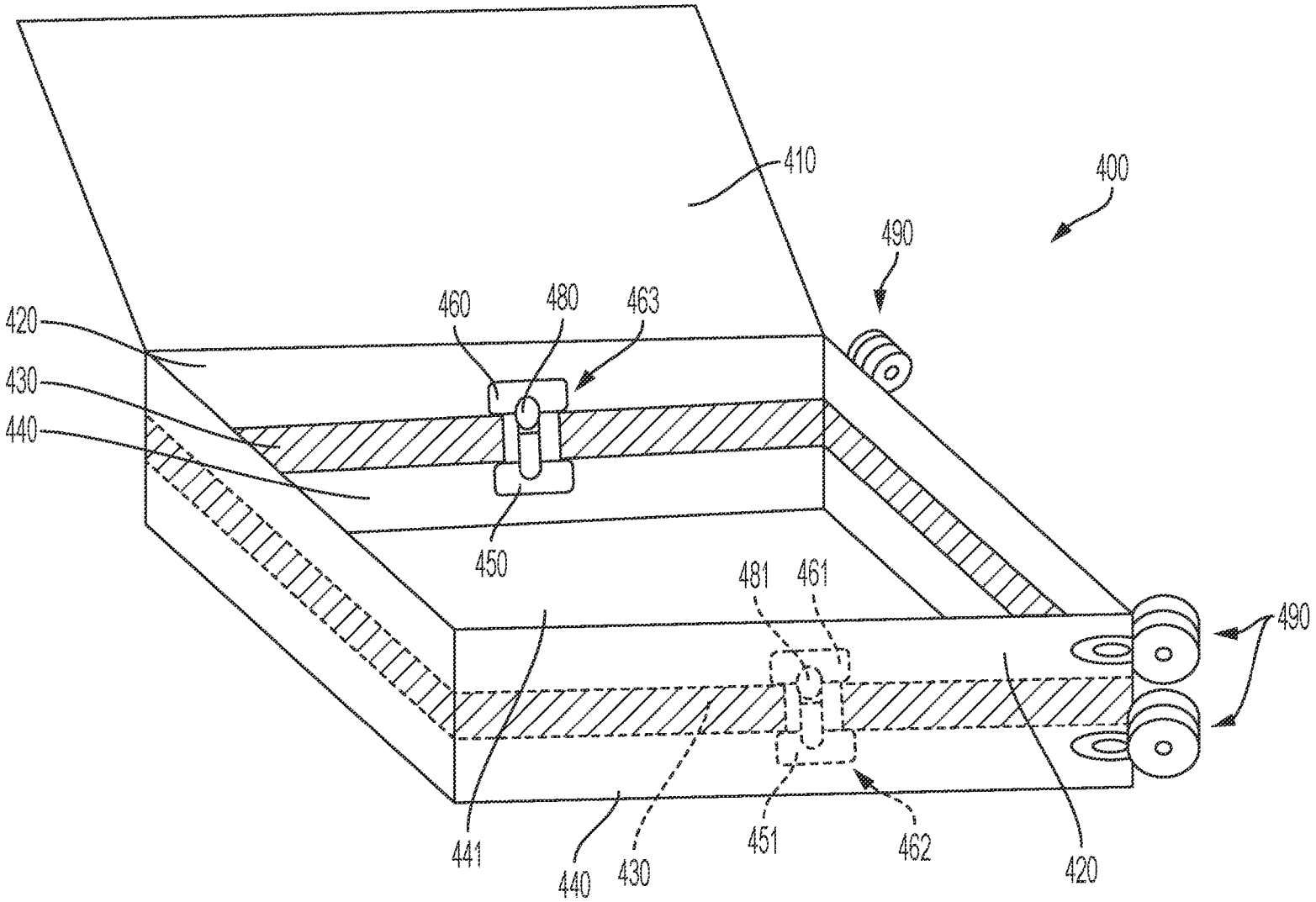
Figure 8C:
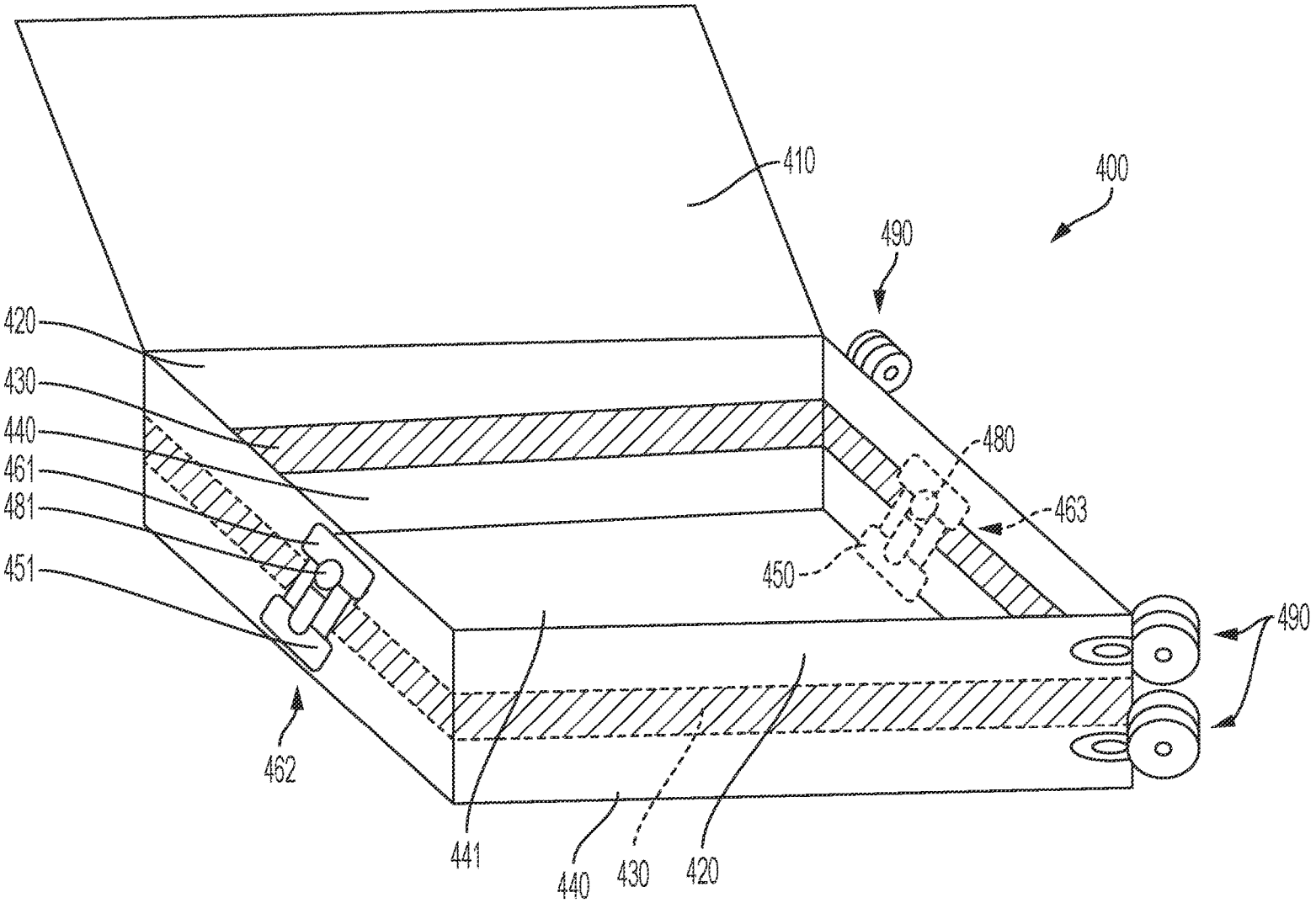
Figure 8D:
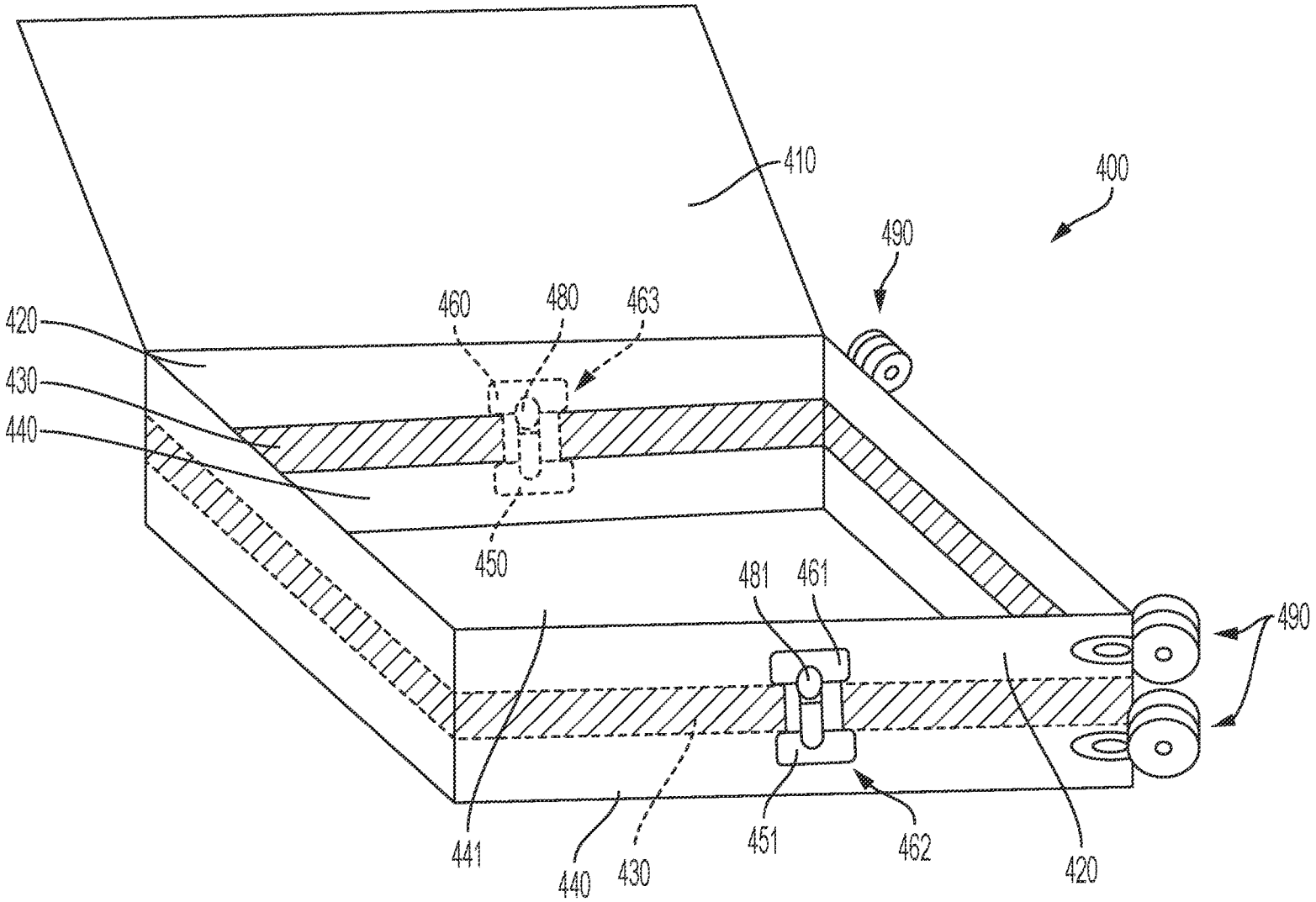

As seen in FIG. 8A, the pair of devices 462, 463 are disposed internally at respective opposite inner walls wherein one such device is affixed to an internal side wall on which the wheels 490 are located (the bottom wall of the luggage when the luggage article is in an upright position, i.e. with the wheels on the ground; and the second such device affixed to the internal side of the opposite wall (the top wall when the luggage article is in the upright position with the wheels on the ground). FIG. 8B depicts another practice wherein two compression-expansion devices 462, 463 are employed, with one affixed to an internal side of the wall that is vertical to the wall on which the wheels 490 are located (the vertical side of the luggage article when it is upright) and a second device is affixed to the internal side of the opposite vertical wall. FIG. 8C depicts yet another practice wherein two compression-expansion devices are employed 462, 463, with one affixed to the outside of the wall on which the wheels 490 are located (the bottom wall of the luggage article is upright), and a second device is affixed to the outside of the opposite wall (the top wall when the luggage article 400 is upright). FIG. 8D depicts still another practice wherein two compression-expansion devices are employed 462, 463 with one affixed to the outside of the wall that is vertical to the wall on which the wheels 490 are located (the vertical side of the luggage article when it is upright) and a second device is affixed to the outside of the opposite vertical wall. When a compression expansion device is located on an external outer wall, coverings may be employed to protect the device. In other practices, one device may be located internally and the other may be located externally.

What is claimed is:

1. A compression-expansion locking device for an article of luggage which comprises:

(a) a housing member comprising:

(i) an inside surface comprising two columns of parallel housing teeth protruding from the inside surface, and (ii) a receiving pocket spanning over at least a portion of the inside surface;

(b) a ratchet member movably disposed within the receiving pocket, the ratchet member comprising:

(i) a top end, a bottom end, and opposing side edges, (ii) a first inner surface positioned opposite the inside surface of the housing member and having at least two upwardly protruding parallel ratchet teeth adapted to releasably engage the housing teeth and to allow movement between the housing member and the ratchet member in a compression direction and to lock movement between the housing member and the ratchet member in an expansion direction, and (iii) a slot disposed between the ratchet teeth and along the axial direction of the first surface of the ratchet member, the slot comprising a bottom surface and a release projection extending upwardly from the bottom surface; and (c) an elongated release member slidably disposed in the slot and comprising (i) a first end located proximate the top end of the ratchet member, and a second end located distal to the top end of the ratchet member, and (ii) a header section disposed along at least part of the length of the elongated release member and into which header section at least a portion of the releasable projection protrudes, the header section comprising a first interior wall camming surface, the header section displaceable from a first position wherein movement of the ratchet member in the expansion direction is locked, to a second position wherein the first interior wall camming surface impinges against the release projection effective to urge the ratchet teeth away from the housing teeth sufficient to allow movement between the housing member and the ratchet member in the expansion direction.

2. The compression-expansion locking device of claim 1 wherein the receiving pocket comprises an edge opening accessing the inside surface and through which edge opening the ratchet member is movably disposed.

3. The compression-expansion locking device of claim 2 wherein the inside surface of the housing member comprises side walls extending outwardly from the inside surface of the housing member, and wherein the side walls of the housing member and the side edges of the ratchet member engage to guide movement of the ratchet member from the first position to the second position.

4. The compression-expansion locking device of claim 1 further comprising a release button connected to the first end of the elongated release member and configured to be moved to the top end of the ratchet member whereby the head section is displaced to the second position.

5. The compression-expansion locking device of claim 1 wherein the ratchet member further comprises a brace disposed over the slot, the brace configured to retain the elongated release member within the slot.

6. The compression-expansion locking device of claim 1 wherein the elongated release member comprises a top surface and the header section comprises a hollow portion within the elongated release member, the hollow portion extending outwardly along a segment of the top surface.

7. The compression-expansion locking device of claim 6 wherein the first interior camming surface is sloped to form an obtuse angle with the top surface of the elongated release member.

8. The compression-expansion locking device of claim 7 wherein the release projection comprises a sloped surface complimentary to the first interior camming surface.

9. The compression-expansion locking device of claim 8 wherein the release projection is triangular in cross section.

10. The compression-expansion locking device of claim 1 wherein the header section comprises a second interior camming surface opposite the first interior camming surface.

11. An article of luggage comprising:

a main luggage body having a bottom surface and a cavity formed to receive articles for packing;

an expansion body having a perimeter defining a cavity;

a foldable gusset joining the luggage main body to the expansion body; and at least one compression-expansion locking device disposed on a wall of the article of luggage, the compression-expansion locking device comprising:

(a) a housing member affixed to one of the luggage main body or the expansion body, the housing member comprising:

(i) an inside surface comprising two columns of parallel housing teeth protruding from the inside surface, and (ii) a receiving pocket spanning over at least a portion of the inside surface;

(b) a ratchet member affixed to the other of the main body or the expansion body, the ratchet member movably disposed within the receiving pocket, the ratchet member comprising:

(i) a top end, a bottom end, and opposing side edges, (ii) a first inner surface positioned opposite the inside surface of the housing member and having at least two outwardly protruding parallel ratchet teeth adapted to releasably engage the housing teeth and to allow movement between the housing member and the ratchet member in a compression direction and to lock movement between the housing member and the ratchet member in an expansion direction, and (iii) a slot disposed between the ratchet teeth and along the axial direction of the first surface of the ratchet member, the slot comprising a bottom surface and a release projection extending upwardly from the bottom surface;

(c) an elongated release member slidably disposed in the slot and comprising (i) a first end located proximate the top end of the ratchet member, and a second end located distal to the top end of the ratchet member, and (ii) a header section disposed along at least part of the length of the elongated release member and into which header section at least a portion of the releasable projection protrudes, the header section comprising a first interior camming surface, the header section displaceable from a first position wherein movement of the ratchet member in the expansion direction is locked, to a second position wherein the first interior camming surface impinges against the release projection effective to urge the ratchet teeth away from the housing teeth sufficient to allow movement between the housing member and the ratchet member in the expansion direction.

12. The article of luggage of claim 11 the receiving pocket comprises an edge opening accessing the inside surface and through which edge opening the ratchet member is movably disposed.

13. The article of luggage of claim 12 wherein the inside surface of the housing member comprises side walls extending outwardly from the inside surface of the housing member, and wherein the side walls of the housing member and the side edges of the ratchet member engage to guide movement of the ratchet member from the first position to the second position.

14. The article of luggage of claim 11 further comprising a release button connected to the first end of the elongated release member and configured to be moved to the top end of the ratchet member whereby the head section is displaced to the second position.

15. The article of luggage of claim 11 wherein the ratchet member further comprises a brace disposed over the slot, the brace configured to retain the elongated release member within the slot.

16. The article of luggage of claim 11 wherein the elongated release member comprises a top surface and the header section comprises a hollow portion within the elongated release member, the hollow portion extending outwardly along a segment of the top surface.

17. The article of luggage of claim 16 wherein the first interior camming surface is sloped to form an obtuse angle with the top surface of the elongated release member.

18. The article of luggage of claim 17 wherein the release projection comprises a sloped surface complimentary to the first interior camming surface.

19. The article of luggage of claim 18 wherein the release projection is triangular in cross section.

20. The article of luggage of claim 11 wherein the header section comprises a second interior camming surface opposite the first interior camming surface.

21. The article of luggage of claim 11 wherein the article of luggage comprises two compression-expansion locking devices each respectively disposed on opposite internal walls of the article or luggage or on opposite external walls of the article of luggage.

22. The article of luggage of claim 21 wherein the two compression-expansion locking devices are internally at respective opposite inner walls of the article of luggage.

* * * * *